United States Patent [19]

Hatayan

[11] 4,079,765

[45] Mar. 21, 1978

[54] IMPLEMENT FOR HOLDING AND GUIDING NAILS

[76] Inventor: Vincent Hatayan, 84 Rue du 22 Septembre, 92400 Courbevoie Becon, France

[21] Appl. No.: 658,829

[22] Filed: Feb. 17, 1976

[30] Foreign Application Priority Data

| | | |
|---|---|---|
| Feb, 19, 1975 | France | 75 05169 |
| May 26, 1975 | France | 75 16266 |

[51] Int. Cl.[2] ..... B25C 3/00

[52] U.S. Cl. ..... 145/46; 24/73 VA; 24/73 MS; 24/85 R; 24/137 R; 81/420; 145/30 A

[58] Field of Search ..... 145/46, 30 R, 30 A; 24/137 R, 138, 255 R, 255 GP, 255 H, 67.9, 73 VA, 85 R, 73 SH, 73 MS, 201 B; 81/420, 425 R, 425 A

[56] References Cited

U.S. PATENT DOCUMENTS

| | | | |
|---|---|---|---|
| 438,848 | 10/1890 | Keyes | 81/420 |
| 612,833 | 10/1898 | Dexter | 145/30 R |
| 682,681 | 9/1901 | Haas | 145/30 R |
| 730,017 | 6/1903 | Helberg | 24/85 R |
| 1,533,043 | 4/1925 | Smith | 145/46 |
| 1,619,744 | 3/1927 | McCloskey | 145/50 C |
| 1,715,819 | 6/1929 | Dealy | 81/425 R |
| 2,475,936 | 7/1949 | Allen | 145/30 A |
| 2,716,750 | 9/1955 | Biblis | 145/46 |
| 2,931,086 | 4/1960 | Rose | 24/137 R |
| 3,060,442 | 10/1962 | Tomek | 145/46 |
| 3,316,949 | 5/1967 | Canfield | 145/46 |
| 3,729,035 | 4/1973 | Manzanarez | 145/46 |
| 3,733,656 | 5/1973 | Stalder | 24/137 R |
| 3,756,550 | 9/1923 | Kollitz | 24/137 R |
| 3,782,388 | 1/1974 | Page | 24/73 VA |

FOREIGN PATENT DOCUMENTS

| | | | |
|---|---|---|---|
| 1,257,621 | 2/1961 | France | 145/46 |
| 2,042,675 | 3/1972 | Germany | 24/137 R |
| 180,862 | 2/1906 | Germany | 145/46 |
| 182,285 | 3/1907 | Germany | 145/46 |
| 165,200 | 11/1958 | Sweden | 24/137 R |
| 60,590 | 5/1912 | Switzerland | 145/46 |

*Primary Examiner*—James L. Jones, Jr.
*Assistant Examiner*—J. T. Zatarga
*Attorney, Agent, or Firm*—Diller, Brown, Ramik & Wight

[57] ABSTRACT

An implement for holding and guiding pointed elongate fasteners such as nails or studs for facilitating their driving into a surface. The implement comprises a pair of levers which are pivotally mounted and biased to a closed position by a bridging portion. Preferably the bridging portion and the levers are of one-piece molded plastic construction. To one side of the bridging portion the levers have jaws and to the other side thereof handles for opening the jaws. The implement may be temporarily secured proximate to where the nail is to be driven in so as to enable a user having only one 'good' hand to drive in the nail.

11 Claims, 10 Drawing Figures

IMPLEMENT FOR HOLDING AND GUIDING NAILS

The present invention relates to a hand implement for holding and guiding pointed elongate fasteners such as nails, studs, or the like for driving the same into a surface with a hammer.

An implement of this type has been disclosed in French Patent No. 1,257,621 comprising a two-armed clip, the arms being pivotally mounted about an axis and provided with jaws which, in contact, define at least one substantially circular opening, the jaws continuing beyond the axis forming handle portions located in a plane parallel to but offset from the general plane of the jaws.

In use, for driving a nail or the like, it is necessary for the user to squeeze the arms of the clip together so as to effectively maintain the nail in position for a certain length of time. Accordingly, the movements of the user must be carefully coordinated thereby requiring a certain dexterity which does not satisfy the desiderata.

U.S. Pat. No. 3,729,035 proposes an implement of this type in which the fastener to be driven is held between two jaws which are spring biased toward each other, one of the jaws terminating in a thimble which is in turn connected to a clip, the thimble and clip being intended to temporarily secure the implement on the user's thumb. It is readily understood that such an implement does not lend itself to easy manipulation owing to the fettering of the user's thumb.

The present invention is concerned with a implement of the family of the above described devices but which, owing to its novel structure, is of a nature to offer new possibilities of use compared to such heretofore known devices.

According to the invention an implement is provided for holding and guiding elongate pointed fasteners such as nails or studs, comprising, to one side of a pivot means a pair of jaws with a series of openings of increasing dimensions formed by notches in opposed clamping faces of said jaws, and a pair of manipulator arms as well as resilient biasing means, wherein the improvement comprises two levers each defining one of the arms and one of the jaws, and said resilient means defining said pivot means, the two levers having a planar bearing surface perpendicular to the opposed clamping faces of the jaws, the entire implement being disposed to the one side of the planar bearing surface.

Advantageously the nail holding and guiding implement according to the invention is of one-piece molded plastic construction; the resilient means defining the pivot means is formed by a bridging portion interconnecting the two levers of the implement.

The configuration of the implement, its reduced size and lightweight construction make it particularly convenient for any potentional user, thereby greatly reducing the chance of the user's fingers being inadvertently struck by the hammer and of damage to the surface being nailed as well as dropping and loss of nails.

According to another characteristic of the nail holding and guiding implement according to the invention the bearing surface provides for the temporarily fixing of the implement to a surface proximate to where the nail is to be driven; for example, the implement fnay be substantially instanteously fixed by means of a self-adhesive pad or strip disposed on the bearing surface. With such a self-adhesive feature the implement can be employed to drive in nails by a user whose arm, hand or finger is infirm which would normally preclude his driving in nails.

Other features and advantages of the invention will be brought out in the following description which is given merely by way of example with reference to the accompanying sheet of drawing in which.

Figure 1:
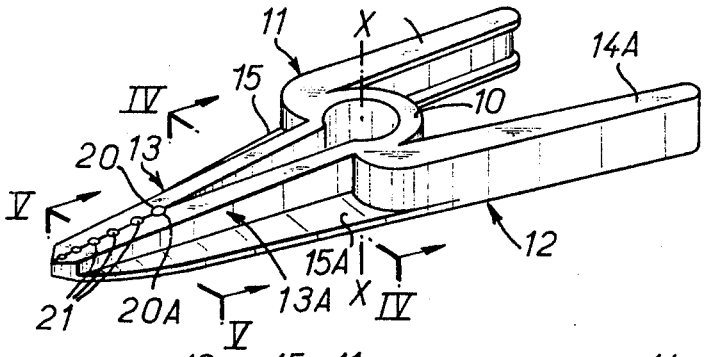
FIG. 1 is a perspective view of a first embodiment of an implement according to the invention.
Figure 2:
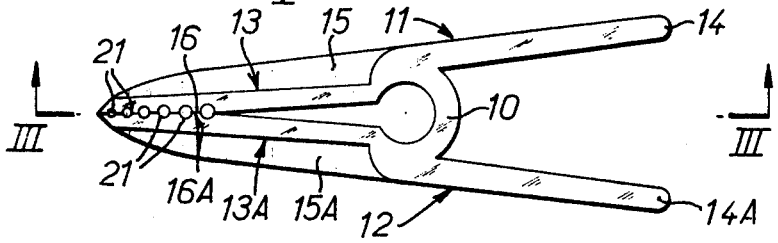
FIG. 2 is a top plan view of the implement shown in FIG. 1.

According to a preferred embodiment of the nail holding and guiding implement illustrated in FIGS. 1-5 it is of onepiece molded plastic construction comprising two levers or lever member 11 and 12 each disposed to one side of the resilient biasing means 10 for biasing their jaws to their normally closed position.

Each of the levers members 11, 12 has a fore end defining a jaw 13, 13A and a rear end defining force applying handle portion 14, 14A.

The jaws 13, 13A (see FIGS. 4 and 5), are L-shaped in cross section and include legs 15, 15A which extend perpendicular to the pivot axis of the levers represented by the phantom line X—X in FIG. 1 and legs 16, 16A which extend parallel to the aforesaid pivot axis X—X, the opposed faces of the last-mentioned legs 16, 16A defining clamping faces.

The legs 15, 15A have a variable length "*l*" which decreases from their junction with the handle portions 14, 14A toward the free ends of the jaws 13, 13A. The legs 15, 15A define a bearing flange for the nail holding and guiding implement, perpendicular to the aforesaid clamping faces.

The clamping faces 16, 16A have a height "*h*" which decreases from their junction with the resilient biasing means towards their free ends; the jaws 13, 13A therefore have a tapered configuration.

The clamping faces 16, 16A are provided with opposed, aligned grooves 20, 20A disposed generally perpendicular to the plane of the bearing flange; these opposed, aligned grooves form a plurality of generally circular passages 21 the diameters of which also progressively increase from the free ends of the jaws.

In the preferred embodiment of FIGS. 1-5 the resilient biasing means 10 is formed as an arcuate bridging portion interconnecting the levers 11, 12. It is also noted that the bridging portion is of thicker construction than the rest of the implement to provide both the required resilience for biasing the jaws to their closed position and the required strength to resist bending stresses exerted when the handle positions pivot the jaw open. Finally, the simplicity and ease of manufacture of such a one-piece molded plastic construction incorporating its own resilient biasing means will of course be readily appreciated.

Figure 6:
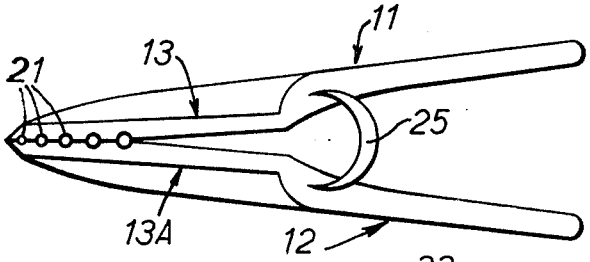
FIG. 6 is a plan view similar to that of FIG. 2 but for another embodiment of the implement.

In the alternative embodiment illustrated in FIG. 6 a separate crescent-shaped resilient bridging member 25 interconnects the levers 11,12 which in this embodiment are initially two independent distinct parts, but otherwise this embodiment is similar in construction to that of the FIG. 1.

Figure 7:
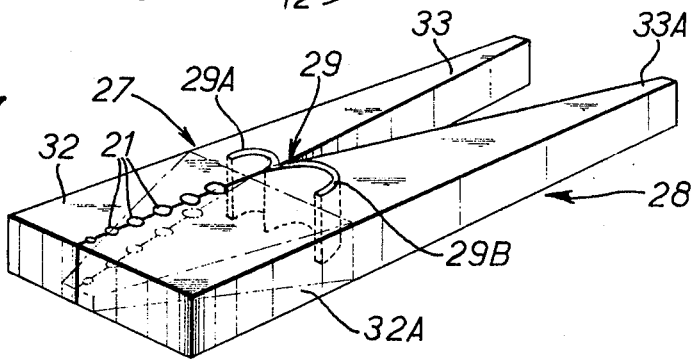
FIG. 7 is a perspective view of still another embodiment of the implement according to the invention.
Figure 8:
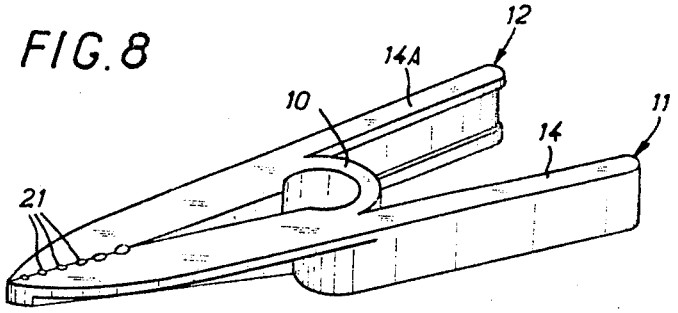
FIG. 8 is a bottom perspective view of the implement of FIG. 1.

The implement of the embodiment of FIG. 7 comprises two levers 27, 28 connected by a double-humped resilient bridging member 29 with its arcuate portions 29A, 29B anchored in levers 27, 28 respectively. The fore ends of the levers have jaws 32, 32A with opposed grooves in their clamping faces and the rear ends force applying handle portions or grips 33, 33A for opening the jaws of the implement to receive a nail in a suitable passage formed by opposed grooves in the clamping faces.

It should be noted that the jaws 32, 32A may either be of constant thickness as shown in solid lines in FIG. 6, or tapered as shown in dash-dotted lines in the same Figure.

Another very interesting feature of the invention consists in the fact that the bearing flange offers the possibility of temporarily securing the implement on the surface into which a nail or other fastener is to be driven. A particularly appreciable advantage of this feature resides in the fact that the implement may be used by anyone having only one 'good' hand and arm, the other being infirmed, thereby alleviating the heretofore unsolved problem of how to drive in a nail with one 'good' hand.

Figure 3:
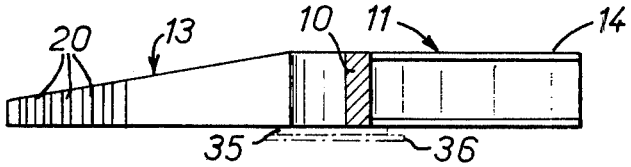
FIG. 3 is a longitudinal section of the implement in FIG. 2 taken along line III—III.
Figure 4:
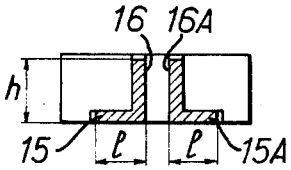
FIGS. 4 and 5 are crosssectional views of the jaws of the implement taken on lines IV—IV and V—V, respectively, in FIG. 1.
Figure 5:
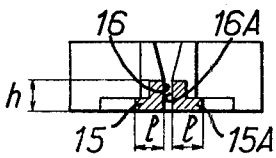

To this end the implement illustrated in FIG. 3 is shown with temporary securing means 35 which advantageously comprises a single or double-faced self-adhesive strip or pad 36 with a releasable protective coating permitting the implement to be temporarily secured to a flat surface proximate to where a nail is to be driven in.

Figure 9:
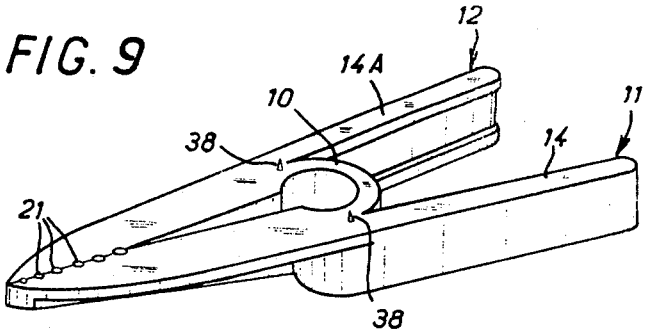
FIG. 9 is a bottom perspective view similar to FIG. 8, but showing an implement having tacks incorporated therein for attaching purposes.

As is shown in FIG. 9, the levers 11, 12 may have carried by the bearing flanges thereof suitable tacks 38 permitting the implement to be temporarily secured to a flat surface approximate to where a nail is to be driven in.

Figure 10:
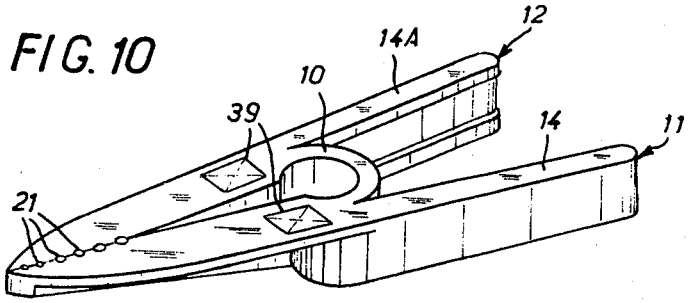
FIG. 10 is another bottom perspective view similar to FIG. 8 and showing the implement having incorporated therein permanent magnets for holding the implement to a metal object.

Each bearing flange may moreover be provided additionally with a platelike permanent magnet 39 secured thereto, as shown in FIG. 10, so as to temporarily secure the implement to a tool box or even a hammer.

I claim:

1. An implement for holding and guiding elongate fasteners to facilitate driving thereof, said implement being of one-piece molded plastic construction and comprising a pair of cooperating lever members, a jaw disposed at a corresponding end of each said lever member, each of said jaws being L-shaped in cross section and including two legs, a first leg of the legs of each jaw facing each other and defining a clamping face having at least one notch generally in alignment with a notch in the clamping face of the other jaw, said notches extending generally transversely to the length of the lever members for receiving and guiding elongate fasteners, the other end of each said lever member defining force applying portion for opening said jaws, a second leg of each jaw defining a planar bearing flange extending perpendicular to said notches, said bearing flanges being arranged coplanar and defining in association with coplanar portions of said force applying portions an enlarged longitudinal outer face of said implement for bearing against a surface proximate to where a fastener is to be driven, and a bridging member integrally formed with said lever members and defining the sole interconnection therebetween, said bridging member constantly biasing said jaws toward each other and defining articulation means for facilitating opening and closing of said jaws.

2. The implement of claim 1 wherein bridging member is generally C-shaped in plan and said first legs form in plan continuations of said bridging member and said lever members in plan extending tangentially from said bridging portion in a direction opposite from that of said jaws.

3. The implement of claim 1 wherein said first legs having opposed inner surfaces each having portions lying in two planes with only those portions remote from said lever members being in contacting relation.

4. An implement according to claim 1, wherein said legs defining the clamping faces taper in height toward the free end of said jaws.

5. An implement according to claim 1, wherein said bridging member is of thickened arcuate configuration with its concave face facing those ends of said lever members provided with said jaws.

6. The implement of claim 1 wherein said first legs are offset inwardly towards each other relative to said lever members.

7. The implement of claim 6 wherein said second legs form in plan continuations of said lever members.

8. An implement according to claim 1 further comprising means provided in said enlarged longitudinal outer face for temporarily securing said implement to a surface proximate to where such elongate pointed fastener is to be driven in.

9. An implement according to claim 8, wherein said temporary securing means includes an adhesive surface parallel and immediately adjacent to said bearing flange.

10. An implement according to claim 8, wherein said temporary securing means includes at least two tacks projecting from said bearing flange.

11. An implement according to claim 8, wherein said temporary securing means includes a permanent magnet disposed at said bearing flange.

* * * * *